US009135855B2

(12) United States Patent
Kawae et al.

(10) Patent No.: US 9,135,855 B2
(45) Date of Patent: Sep. 15, 2015

(54) DISPLAY DEVICE, ELECTRONIC DEVICE, DRIVING CIRCUIT, AND DRIVING METHOD THEREOF

(71) Applicant: SAMSUNG DISPLAY CO., LTD., Yongin, Gyeonggi-Do (KR)

(72) Inventors: Daisuke Kawae, Yokohama (JP); Ryo Ishii, Yokohama (JP); Naoaki Komiya, Yokohama (JP)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 101 days.

(21) Appl. No.: 13/966,971

(22) Filed: Aug. 14, 2013

(65) Prior Publication Data

US 2014/0049182 A1 Feb. 20, 2014

(30) Foreign Application Priority Data

Aug. 14, 2012 (JP) ..... 2012-179708

(51) Int. Cl.
*G09G 3/30* (2006.01)
*G09G 3/32* (2006.01)

(52) U.S. Cl.
CPC ..... *G09G 3/3233* (2013.01); *G09G 2300/0852* (2013.01); *G09G 2300/0861* (2013.01)

(58) Field of Classification Search
None
See application file for complete search history.

(56) References Cited

U.S. PATENT DOCUMENTS 7,358,937 B2 * 4/2008 Suzuki ..... 345/76
7,876,294 B2 * 1/2011 Sasaki et al. ..... 345/77
2008/0278464 A1 * 11/2008 Yamamoto et al. ..... 345/204

FOREIGN PATENT DOCUMENTS

JP 2003-330416 A 11/2003
JP 2006-030946 A 2/2006
JP 4197647 B2 10/2008

* cited by examiner

*Primary Examiner* — Douglas W Owens
*Assistant Examiner* — Dedei K Hammond
(74) *Attorney, Agent, or Firm* — Lee & Morse, P.C.

(57) ABSTRACT

A display device includes a pixel circuit that supplies current to a light emitting diode (LED) and a driver circuit. The pixel circuit includes a constant current circuit including a first transistor and a capacitor connected to a gate terminal of the first transistor, and a switch circuit including a second transistor. The driver circuit controls the pixel circuit such that the LED emits light by connecting the anode of the LED diode and the first power line under a non-light emission state of the LED, connecting the gate terminal of the first transistor and the anode after the anode is disconnected from the first power line, setting the gate terminal of the first transistor to a voltage corresponding to an amount of a supply current from the first power line, and after setting the gate terminal, switching a state of the LED into a light emission state.

8 Claims, 14 Drawing Sheets

DISPLAY DEVICE, ELECTRONIC DEVICE, DRIVING CIRCUIT, AND DRIVING METHOD THEREOF

CROSS-REFERENCE TO RELATED APPLICATIONS

A claim for priority under 35 U.S.C. §119 is made to JP Application No. 2012-179708 filed Aug. 14, 2012, in the Japanese Intellectual Property Office, the entire contents of which are hereby incorporated by reference.

BACKGROUND

In recent years, there is being developed a display device (e.g., Organic Electroluminescence (EL), etc.) using a light emitting diode that emits light according to the intensity of current supplied. In such a display device, gray scale of a display image is controlled by controlling the amount of current supplied to a light emitting diode using a driving transistor of a pixel. If a characteristic of the driving transistor is varied, the characteristic variation may appear directly on a display image.

Influence of a characteristic variation of the driving transistor on a display image is reduced by using a technique (e.g., referred as a threshold voltage compensation technique) of suppressing a threshold voltage variation of a transistor through a constant current circuit configured to supply a current to the organic electroluminescence constantly. However, such a threshold voltage compensation technique causes an increase in the number of transistors per pixel. Thus, the threshold voltage compensation technique is not practical for high density.

SUMMARY

An embodiment provides a display device which comprises a pixel circuit including a light emitting diode emitting a light according to a supply current; and a driver circuit configured to drive the pixel circuit such that the light emitting diode emits a light. The pixel circuit further includes a constant current circuit including a first transistor to control an amount of the supply current to the light emitting diode and a capacitive element connected to a gate terminal of the first transistor; and a switch including a second transistor to select whether to switch the supply current, the first and second transistors being connected in series between a first power line and an anode of the light emitting diode having a cathode connected to a second power line. The driver circuit controls the pixel circuit such that the light emitting diode emits a light, by connecting the anode of the light emitting diode and the first power line under a non-light emission state of the light emitting diode, connecting the gate terminal of the first transistor and the anode after the anode is disconnected from the first power line, setting the gate terminal of the first transistor to a voltage corresponding to the amount of the supply current with the gate terminal of the first transistor and the first power line being connected, and after the setting, switching the supply current through the second transistor under a light emission state of the light emitting diode.

The capacitive element may be disposed between the gate terminal of the first transistor and a first signal line. The constant current circuit may further include a third transistor having a gate terminal connected to a second signal line and disposed between the gate terminal of the first transistor and a terminal of the first transistor placed at a side of the light emitting diode. The switch circuit may further include a fourth transistor disposed between a data line and a gate terminal of the second transistor and having a gate terminal connected to a third signal line, and the driver circuit drives the pixel circuit by controlling voltages of the first power line, the second power line, the first signal line, the second signal line, the third signal line, and the data line.

Another embodiment is directed to providing a method of driving a pixel circuit that includes a light emitting diode emitting a light according to a supply current; a constant current circuit including a first transistor to control an amount of the supply current to the light emitting diode and a capacitive element connected to a gate terminal of the first transistor; and a switch including a second transistor to select whether to switch the supply current, the first and second transistors being connected in series between a first power line and an anode of the light emitting diode having a cathode connected to a second power line. The method includes connecting the anode of the light emitting diode and the first power line under a non-light emission state of the light emitting diode; then connecting the gate terminal of the first transistor and the anode after the anode is disconnected from the first power line; setting the gate terminal of the first transistor to a voltage corresponding to the amount of the supply current by connecting the gate terminal of the first transistor and the first power line, and after the setting, switching the supply current through the second transistor under a light emission state of the light emitting diode such that the light emitting diode emits a light.

Still another embodiment is directed to provide a driver circuit of driving a pixel circuit that includes a light emitting diode emitting a light according to a supply current; a constant current circuit including a first transistor to control an amount of the supply current to the light emitting diode and a capacitive element connected to a gate terminal of the first transistor; and a switch including a second transistor to select whether to switch the supply current, the first and second transistors being connected in series between a first power line and an anode of the light emitting diode having a cathode connected to a second power line. The driver circuit connects the anode of the light emitting diode and the first power line under a non-light emission state of the light emitting diode; then connects the gate terminal of the first transistor and the anode after the anode is disconnected from the first power line; sets the gate terminal of the first transistor to a voltage corresponding to the amount of the supply current by connecting the gate terminal of the first transistor and the first power line, and after the setting, switches the supply current through the second transistor under a light emission state of the light emitting diode such that the light emitting diode emits light.

DETAILED DESCRIPTION

Figure 1:
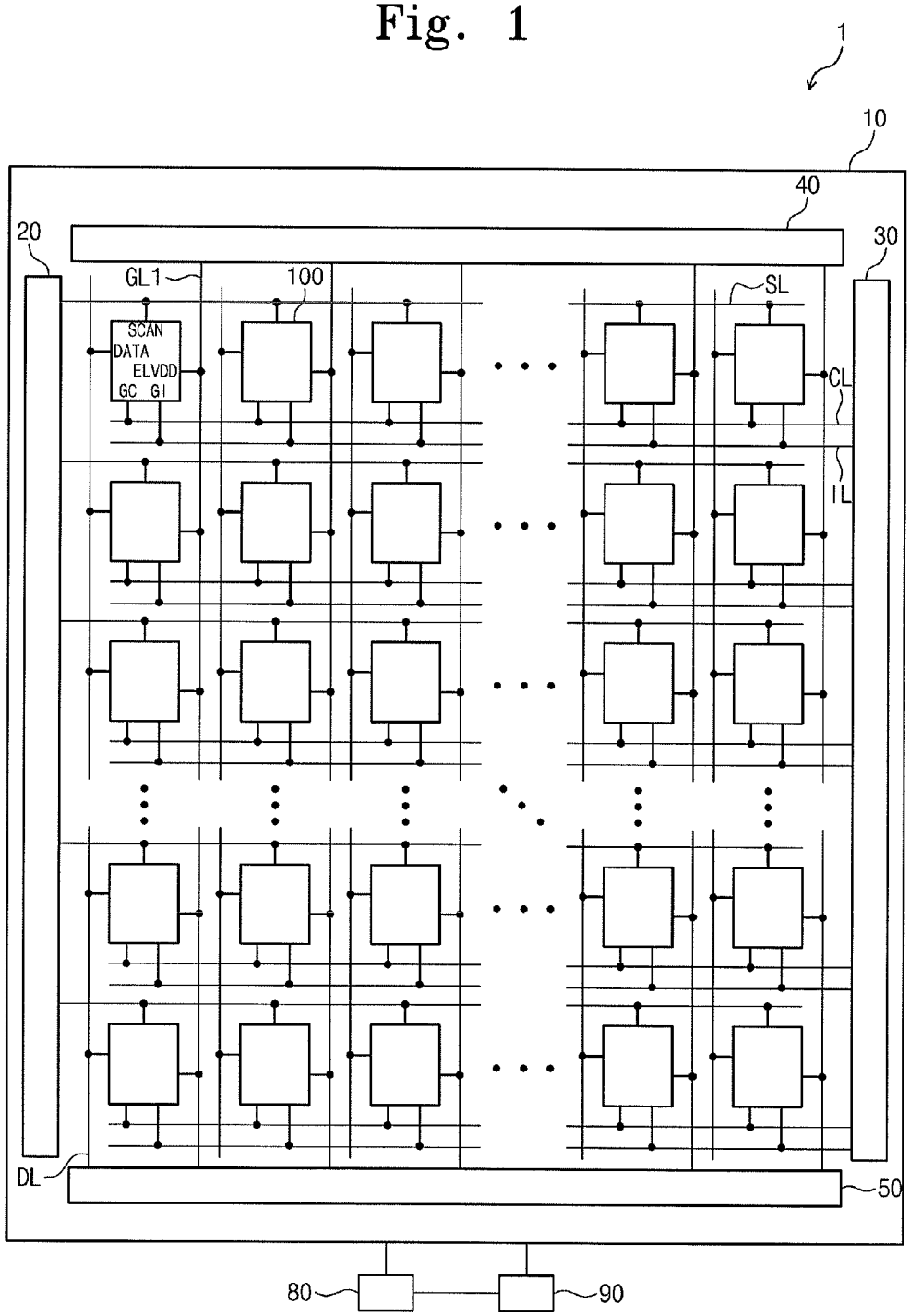
FIG. 1 is a diagram schematically illustrating an electronic device according to an embodiment.

Embodiments will be described in detail with reference to the accompanying drawings. These may be embodied in various different forms, and should not be construed as being limited only to the illustrated embodiments. Rather, these embodiments are provided as examples so that this disclosure will be thorough and complete, and will fully convey the concept to those skilled in the art. Accordingly, known processes, elements, and techniques are not described with respect to some of the embodiments. Unless otherwise noted, like reference numerals denote like elements throughout the attached drawings and written description, and thus descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings herein.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

An electronic device according to embodiments will be more fully described with reference to accompanying drawings.

FIG. 1 is a diagram schematically illustrating an electronic device 1 according to an embodiment. An electronic device 1 may be, for example, a smart phone, a cellular phone, a personal computer, a television, etc., and includes a display unit for displaying images. The electronic device 1 includes a display device 10, a control unit 80, and a power supply 90. The display device 10 includes a pixel circuit 100 of pixels arranged in a matrix form. The display device 10 that forms the display unit displays images through light emitting diodes of the pixel circuit 100. The pixel circuit 100 includes light emitting diodes EL (refer to FIG. 3). In exemplary embodiments, the light emitting diode EL is an Organic Light Emitting Diode (OLED), but embodiments are not limited thereto, e.g., may be used by a light emitting element having a rectification characteristic. The light emitting diode EL has a capacitive component C2.

In FIG. 1, the pixel circuit 100 has a matrix form, but embodiments are not limited thereto. Below, it is assumed that the pixel circuit 100 has an n m matrix form. The pixel circuit 100 includes different colors of light emitting diodes EL every column. In exemplary embodiments, red, green, and blue sub-pixels are arranged sequentially and iteratively form a first column. The display device 10 will be more fully described later.

The control unit 80 includes a Central Processing Unit (CPU), a memory, etc., and controls an operation of the display device 10. The control unit 80 controls a scanning line driving circuit 20, a constant current setting circuit 30, a power line driving circuit 40, and a data line driving circuit 50. The control unit 80 controls a light emitting operation of a light emitting diode EL of each pixel in the pixel circuit 100 by receiving image data indicating an image to be displayed on the display unit of the electronic device 1, determining gray scale of each pixel in the pixel circuit 100 based on the input image data, and supplying a data voltage corresponding to the determined gray scale to the pixel circuit 100.

The power supply 90 powers components of the electronic device 1 including the display device 10, the control unit 80, etc. In the display device 10, a current is supplied to the light emitting diode EL of each pixel of the pixel circuit 100 through a power line GL1 (or, a first power line) and a power line GL2 (or, a second power line) connected to the power supply 90 (refer to FIG. 3).

The display device 10 includes the pixel circuit 100, the scanning line driving circuit 20, the constant current setting circuit 30, the power line driving circuit 40, and the data line driving circuit 50. The scanning line driving circuit 20, the constant current setting circuit 30, the power line driving circuit 40, and the data line driving circuit 50 may constitute a driver circuit for driving the pixel circuit 100.

The scanning line driving circuit 20 supplies a scanning signal SCAN to a scanning line SL (a third signal line) provided to correspond to each row of the pixel circuit 100.

The scanning line driving circuit 20 selects a row of the pixel circuit 100, in which a data voltage is written, in response to the scanning signal SCAN. In exemplary embodiments, rows of the pixel circuit 100 may be selected sequentially and exclusively in an order of a $1^{st}$ row, a $2^{nd}$ row, . . . , an $n^{th}$ row. During a constant current setting period (to be more fully described later), the scanning line driving circuit 20 supplies the scanning line SCAN the voltage which is common to all rows of the pixel circuit 100.

The constant current setting circuit 30 supplies a control signal GC to a signal line CL (a first signal line) provided to correspond to each row of the pixel circuit 100. The constant current setting circuit 30 supplies a control signal GI to a signal line IL (a second signal line) provided to correspond to each row of the pixel circuit 100. The control signals GC and GI are used to drive the pixel circuit 100 during the constant current setting period, and their voltages are constantly maintained during the remaining period except for the constant current setting period. During the constant current setting period, the constant current setting circuit 30 supplies the control signal GC, the voltage of which is, common with respect to all rows of the pixel circuit 100, and the control signal GI, the voltage of which is common with respect to all rows of the pixel circuit 100.

The data line driving circuit 50 supplies a data signal DATA to a data line DL provided to correspond to each column of the pixel circuit 100. The data signal DATA is a signal for defining a period where light emitting diodes EL of the pixel circuit 100 emit light. The data signal DATA is a signal for switching a data voltage for light emission of the light emitting diodes EL and a data voltage for non-light emission thereof according to image data provided to the control unit 80. During the constant current setting period, the data line driving circuit 50 supplies the data signal DATA the voltage of which is common to all rows of the pixel circuit 100.

The power line driving circuit 40 supplies the power signal ELVDD to the power line GL1 provided to correspond to each column of the pixel circuit 100. The power signal ELVDD is a signal for supplying a current for light emission of the light emitting diodes EL of the pixel circuit 100. The power signal ELVDD is converted into a positive voltage VH for current supply, a negative voltage VL for current supply, and a constant current setting voltage Von during the constant current setting period. In exemplary embodiments, the constant current setting voltage Von is set to a different value for every light emission color (RGB) of each light emitting diode.

A constant current setting voltage Von(R) is supplied to the pixel circuit 100 corresponding to red light (hereinafter "R"), a constant current setting voltage Von(G) is supplied to the pixel circuit 100 corresponding to green light (hereinafter "G"), and a constant current setting voltage Von(B) is supplied to the pixel circuit 100 corresponding to B (hereinafter "B"). A constant current setting voltage corresponding to a light emission color of a light emitting diode is decided according to a light emission characteristic of each color of the light emitting diode and display setting (color temperature, etc.) of an image. The power signal ELVDD is fixed to a voltage VH during periods other than the constant current setting period. If a color of the light emitting diode is one (monochrome), the power line ELVDD may be set to a single constant current setting voltage Von.

Figure 3:
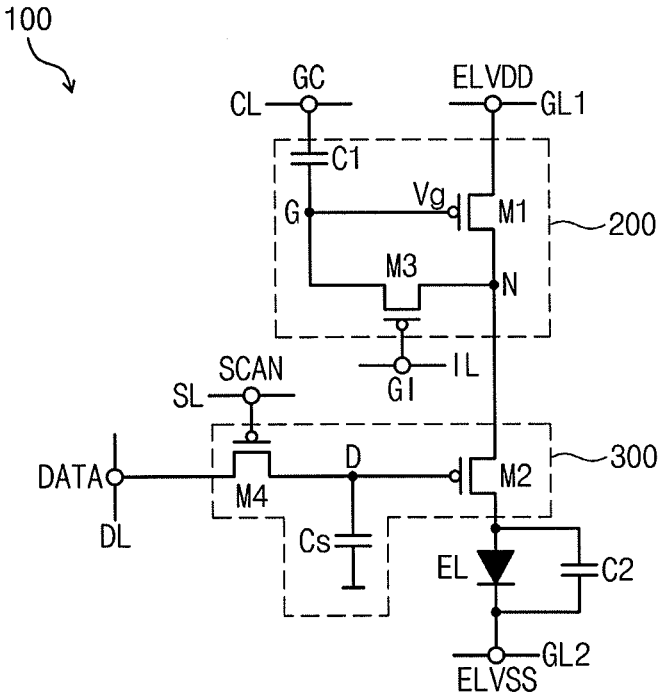
FIG. 3 is a circuit diagram schematically illustrating a pixel circuit according to an embodiment.

The power line driving circuit 40 supplies the power signal ELVSS to the power line GL2 (refer to FIG. 3). The power signal ELVSS is switched to the positive voltage VH for current supply or a negative voltage VL for current supply during the constant current setting period and is fixed to the voltage VL during periods other than the constant current setting period.

Figure 2:
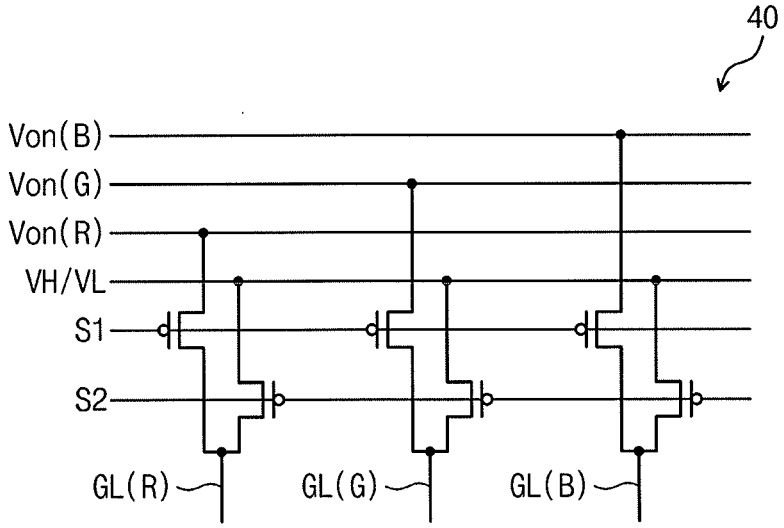
FIG. 2 is a circuit diagram schematically illustrating a power line driving circuit 40 according to an embodiment.

FIG. 2 is a circuit diagram schematically illustrating a power line driving circuit 40 according to an embodiment. A power line driving circuit 40 may be formed of p-type Thin Film Transistors (TFTs) connected as illustrated in FIG. 2. Below, a transistor may be a p-type TFT if a specific type is not otherwise noted.

A power line GL(R) supplies the power signal ELVDD to a column of a pixel circuit 100 corresponding to R. A power line GL(G) supplies the power signal ELVDD to a column of a pixel circuit 100 corresponding to G. A power line GL(B) supplies the power signal ELVDD to a column of a pixel circuit 100 corresponding to B. When a transistor connected to a signal line S1 is turned on (or, is in an on state), a transistor connected to a signal line S2 is turned off (or, is at in off state). When a transistor connected to the signal line S2 is turned on, a transistor connected to the signal line S1 is turned off. The voltages of the signals S1, S2 are controlled by a control unit 80.

Thus, in the event that a transistor connected to the signal line S2 is only in a turn-on state, the power signal ELVDD supplied to the power lines GL(R), GL(G), and GL(B) has one of a voltage VH and a voltage VL. The power signal ELVDD may be set to the voltage VH or the voltage VL under control of the control unit 80.

In the event that a transistor connected to the signal line S1 is in a turn-on state, the power signal ELVDD supplied to the power lines GL(R) has a constant current setting voltage Von(R), the power signal ELVDD supplied to the power lines GL(G) has a constant current setting voltage Von(G), and the power signal ELVDD supplied to the power lines GL(B) has a constant current setting voltage Von(B). Components of the display device 10 are described with reference to FIGS. 1 and 2.

FIG. 3 is a circuit diagram schematically illustrating the pixel circuit 100 according to an embodiment. The pixel circuit 100 includes a constant current circuit 200, a switch circuit 300, and a light emitting diode EL having a capacitive component C2. The light emitting diode EL has a cathode connected to a power line GL2 and is supplied with a power signal ELVSS. The constant current circuit 200 and the switch circuit 300 are connected in series between an anode of the light emitting diode EL and the power line GL1. In exemplary embodiments, the switch circuit 300 may be provided between the anode of the light emitting diode EL and the constant current circuit 200.

The constant current circuit 200 includes two transistors M1 and M3 and a capacitive element C1. A capacitance of the capacitive element C1 may be similar to that of the capacitive component C2 (e.g., 1/10 to 10 times the capacitance thereof). The switch circuit 300 includes two transistors M2 and M4 and a capacitive element Cs. As described above, the pixel circuit 100 includes four transistors M1 to M4.

The transistor M1 (a first transistor) acts as a constant current source for controlling the amount of current, flowing through the transistor M1, according to a voltage of a gate terminal of the transistor M1. One of source and drain terminals of the transistor M1 may be connected to the power line GL1 to receive the power signal ELVDD, and another one thereof may be connected to a source terminal or a drain terminal of the transistor M2. Where the first and second transistors M1 and M2 are connected may be referred to as a node N.

A first electrode of the capacitive element C1 is connected to the signal line CL to receive the control signal GC and a second electrode thereof is connected to the gate terminal of the transistor M1. Where the transistor M1 and the capacitive element C1 are connected may be referred to as a node G. A voltage applied to the gate terminal of the transistor M1 may be referred to as a gate voltage Vg. The capacitive element C1 may maintain the gate voltage Vg.

The transistor M3 (a third transistor) controls the gate voltage Vg to connect or disconnect the nodes G and N. One of source and drain terminals of the transistor M3 is connected to the node N, and another one thereof is connected to the node G. A gate terminal of the transistor M3 is connected to a signal line IL to receive a control signal GI.

The transistor M2 (a second transistor) selectively supplies current to the light emitting diode according to a voltage of its gate terminal. One of source and drain terminals of the transistor M2 is connected to the node N, and another one thereof is connected to the anode of the light emitting diode EL. A gate terminal of the transistor M2 is connected to one of source and drain terminals of the transistor M4 (a fourth transistor). Where the transistors M2 and M4 are connected may be referred to a node D.

The transistor M4 controls timing when a data signal DATA is received from a data line DL. One of source and drain terminals of the transistor M4 is connected to the node D, and another one thereof is connected to a data line DL to receive the data signal DATA. A gate terminal of the transistor M4 is connected to a scanning line SL to receive a scanning signal SCAN. The capacitive element Cs is an auxiliary capacitive element for maintaining a data voltage of the node D, and has a first electrode connected to the node D and a second electrode connected to a line the voltage of which is fixed to a predetermined voltage (e.g., a ground voltage). Since the capacitive element Cs is auxiliary, it may not be present according to design conditions such as a level of leak current of a transistor, a noise level, etc. The above description is associated with components of the pixel circuit 100.

Figure 4:
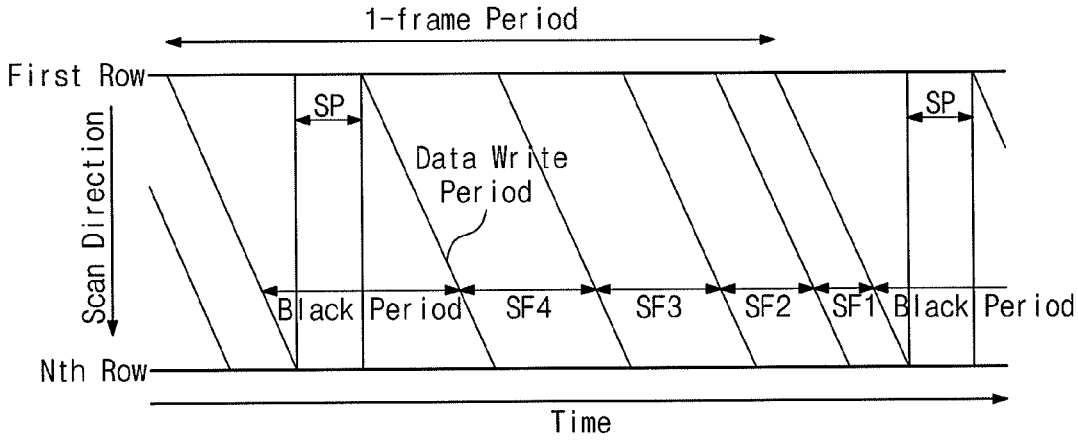
FIG. 4 is a diagram schematically illustrating timing when each row of a pixel circuit 100 is driven during a 1-frame period, according to an embodiment.

FIG. 4 is a diagram schematically illustrating timing when each row of a pixel circuit 100 is driven during a 1-frame period, according to an embodiment. A 1-frame period is formed of a black period and a plurality of sub-frame periods. In exemplary embodiments, the 1-frame period includes four sub-frame periods SF1 to SF4 having different lengths, and light emission and non-light emission of a light emitting diode EL are controlled by the sub-frame period. Below, such light emission control may be referred to as Pulse Width Modulation (PWM) light emission control. The number of sub-frame periods is variable. Also, each sub-frame period has a binary code weighted rate. However, embodiments are not limited thereto.

Oblique lines illustrated in FIG. 4 indicate rows of a pixel circuit 100, selected in a predetermined order of 1st to nth rows according to a scanning signal SCAN, over time. Referring to this timing, in each row of the pixel circuit 100, a data voltage is transferred to a node D from a data line DL of each column, so that a light emitting diode EL is switched into a light emission state or a non-light emission state.

During the black period, the light emitting diode EL is set to the non-light emission state. Part of the black period is allocated to the above-described constant current setting period SP. The constant current setting period SP is defined by a period between a point of time when light emitting diodes EL of all pixels of the pixel circuit 100 have a non-light emission state and a point of time when a first sub-frame period of the pixel circuit 100 (a first row of the pixel circuit 100 illustrated in FIG. 4) starts. As illustrated in FIG. 4, although the black period and a sub-frame period are interlocked by a row of the pixel circuit 10, the constant current setting period SP is decided such that all pixels of the pixel circuit 100 have the same period.

Figure 5:
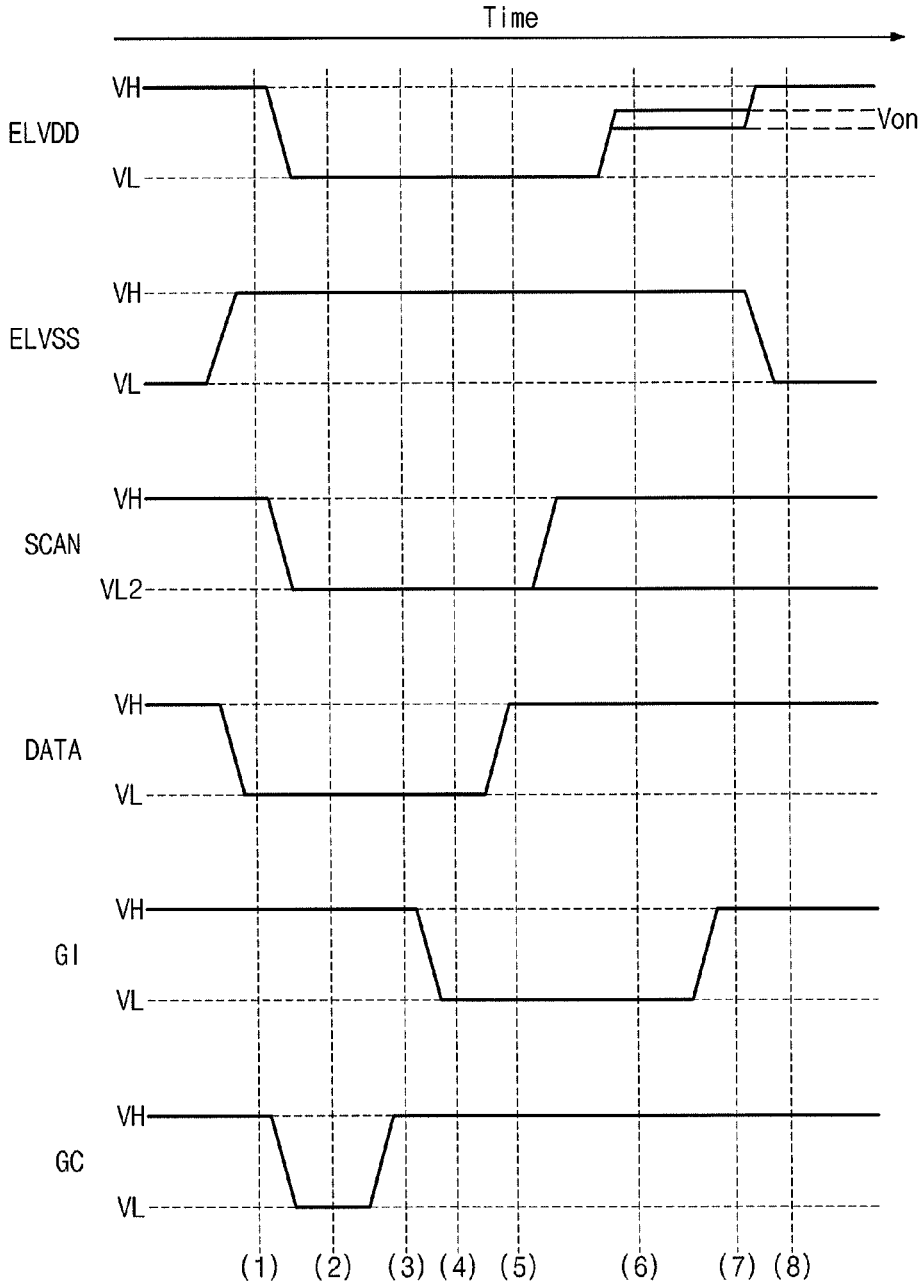
FIG. 5 is a timing diagram schematically illustrating variations of signals during a constant current setting period, according to an embodiment.

FIG. 5 is a timing diagram schematically illustrating variations of signals during a constant current setting period, according to an embodiment. Voltages of input signals (including power signals ELVDD and ELVSS, a scanning signal SCAN, a data signal DATA, control signals GI and GC) are switched between a voltage VH and a voltage VL. Here, the scanning signal SCAN has not only the voltage VL but also a voltage VL2 lower than the voltage VL. A width of a constant current setting voltage Von is based on differences among Von(R), Von(G), and Von(B). In the event that differences among Von(R), Von(G), and Von(B) are not distinguished, an operation will be described using 'Von'. In exemplary embodiments, the voltages VH and VL of each signal are described to be equal to those of other signals. In the event that it is possible to implement an operation to be described below, the voltages VH and VL may be varied according to a signal.

Below, an operation of a pixel circuit 100 according to each timing (1) to (8) illustrated in FIG. 5 will be more fully described with reference to FIGS. 6 to 13.

Figure 6:
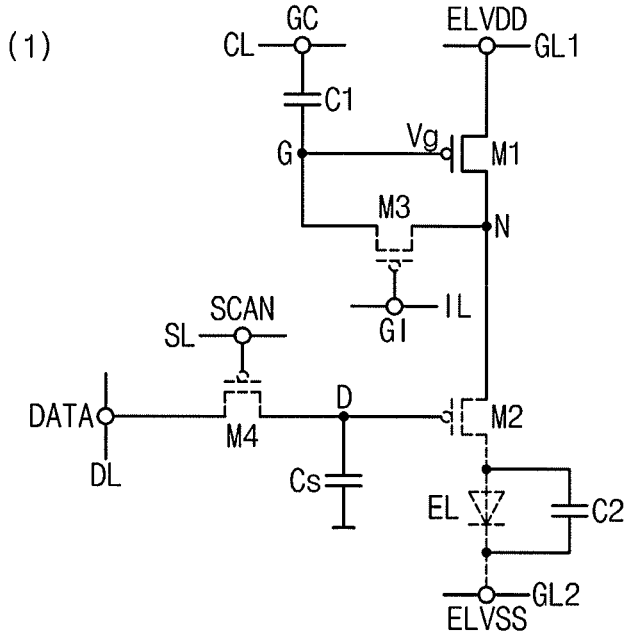
FIGS. 6 to 13 are diagrams schematically illustrating driving states of a pixel circuit 100 corresponding to timings (1) to (8) illustrated in FIG. 5, according to an embodiment.

FIGS. 6 to 13 are diagrams schematically illustrating driving states of a pixel circuit 100 corresponding to timings (1) to (8) illustrated in FIG. 5, according to an embodiment. Referring to FIG. 6, which shows a driving state of a pixel circuit 100 corresponding to a timing (1), since the transistor M2 is at a turn-off state, no current flows to a light emitting diode EL. Here, as illustrated in FIG. 6, a dotted line indicates a state where although the transistor M2 is turned on, no current flows to the light emitting diode EL due to a voltage relation between ELVDD and ELVSS. This condition is identically applied to figures after FIG. 7.

Since the transistor M1 maintains a state of a previous frame, it may be turned on. Also, since a voltage VH is applied to gate terminals of transistors M2 to M4, the transistors M2 to M4 are turned off. Here, dotted lines illustrated in FIG. 6 indicate that transistors are turned off. This condition is identically applied to figures after FIG. 7.

Figure 7:
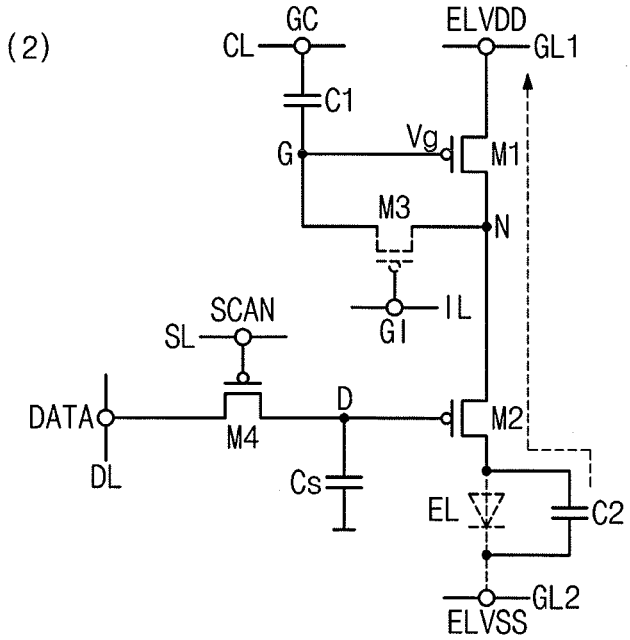

Referring to FIG. 7 which shows a driving state of the pixel circuit 100 corresponding to a timing (2), since ELVDD becomes VL and is lower than ELVSS, the light emitting diode EL is reversely biased, so that no current flows to the light emitting diode EL. That is, light is not emitted. Also, a voltage relation between ELVDD and ELVSS is set such that the light emitting diode EL is at a non-light emission state. Meanwhile, as GC is decreased into VL, Vg is lowered due to capacitive coupling. At this time, although ELVDD goes to VL, the transistor M1 maintains a turn-on state. As SCAN is lowered toward VL2, the transistor M4 is turned on. At this time a voltage VL of the data signal DATA is applied to a node D. Thus, the transistor M2 is turned on. With this bias condition, an electrode of a capacitive component C2 connected to the node N is connected to a power line GL1, so that charges are transferred. Thus, a voltage of the node N is decreased.

Figure 8:
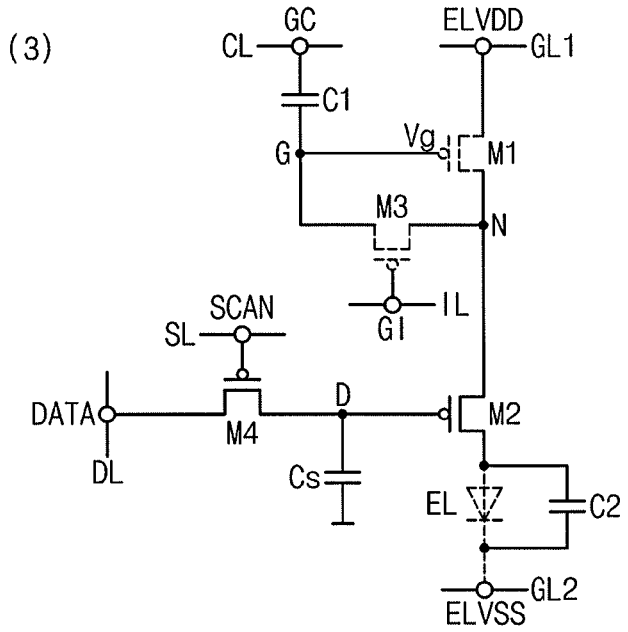

Referring to FIG. 8 which shows a driving state of the pixel circuit 100 corresponding to a timing (3), as GC is increased up to VH, Vg is increased by the capacitive coupling. Thus, the transistor M1 is turned off.

Figure 9:
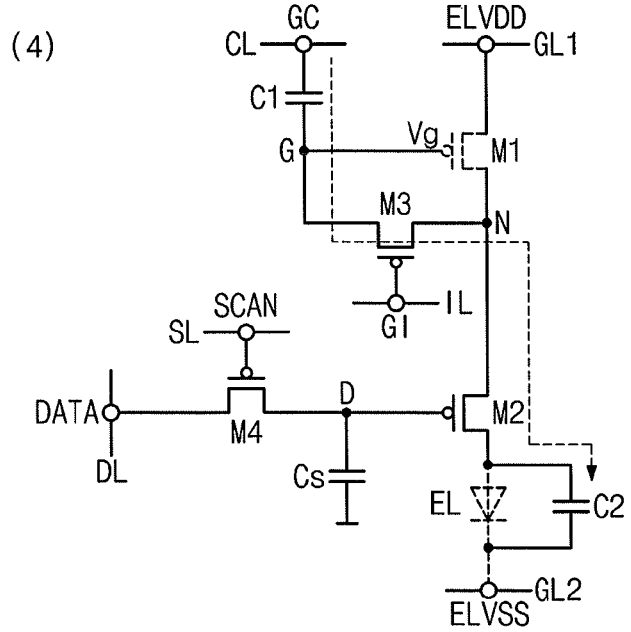

Referring to FIG. 9 which shows a driving state of the pixel circuit 100 corresponding to a timing (4), as GI is decreased into VL, a transistor M3 is turned on. At this time, an electrode of the capacitive element C1 connected to the node G is connected to the node N1, so that charges are transferred. That is, Vg (a voltage of the node G) is lowered. In this case, since a voltage of the node N is equal to Vg, the transistor M1 maintains a turn-off state. During a constant current setting period SP, an operation of lowering Vg is referred to as a reset operation.

Since the reset operation is performed using the capacitive component C2 of the light emitting diode EL, the transistor M2 has to maintain a turn-on state from the timing (2) to the timing (4). Although the transistors M1 and M2 are simultaneously turned on as illustrated in the timing (2), the light emitting diode EL maintains a non-light emission state by a voltage relation between ELVDD and ELVSS.

Figure 10:
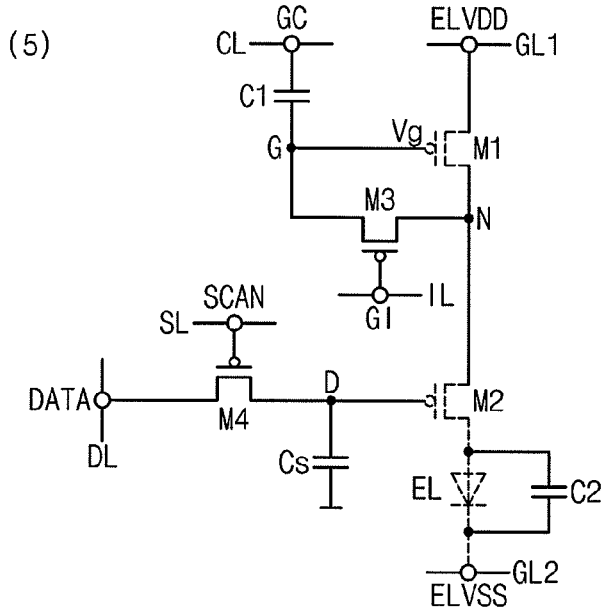

Referring to FIG. 10 which shows a driving state of the pixel circuit 100 corresponding to a timing (5), DATA rises up to VH and a voltage of a node D becomes VH. Thus, the transistor M2 is turned off. Afterwards, SCAN becomes VH and a transistor M4 is turned off. Also, during the constant current setting period SP, SCAN may maintain VL2.

Figure 11:
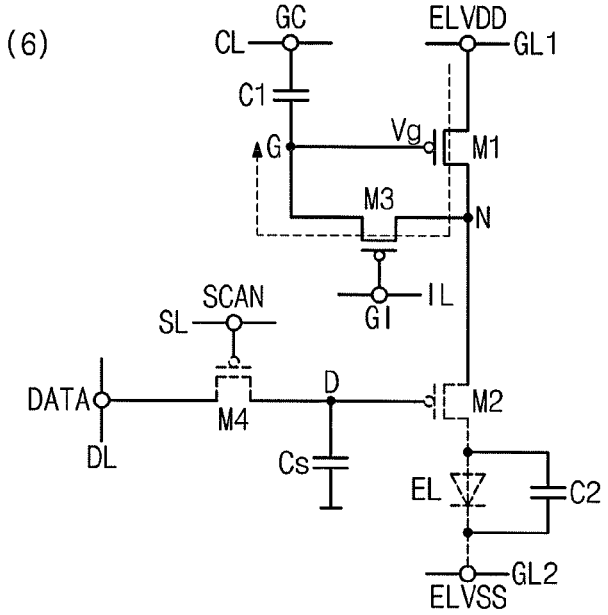

Referring to FIG. 11 which shows a driving state of the pixel circuit 100 corresponding to a timing (6), as ELVDD rises up to Von, the transistor M1 is turned on. At this time, since a voltage of Vg is lowered by the reset operation, the transistor M1 is fully turned on.

With the above description, an electrode of the capacitive element C1 connected to the node G is connected to a power line GL1, charges are transferred. Thus, Vg rises up to (Von−|Vth|). At this time, since ELVDD becomes one of Von(R), Von(G), and Von(B) according to a light emission color of the light emitting diode EL, a value of Vg is variable.

Figure 12:
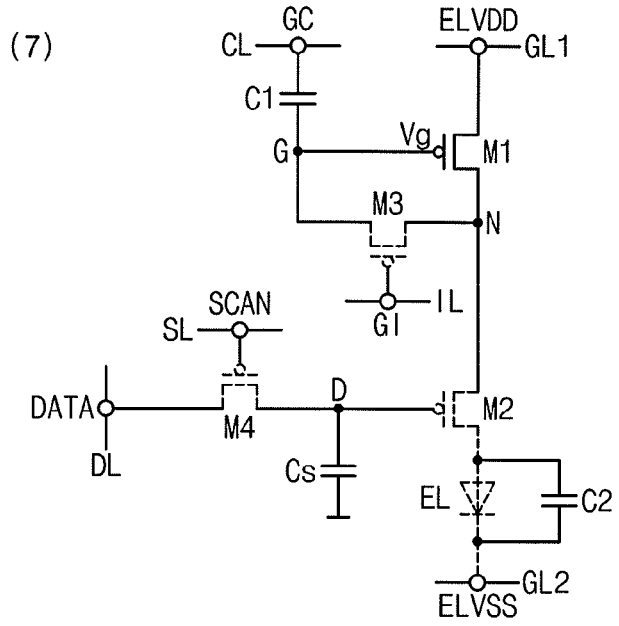

Referring to FIG. 12 which shows a driving state of the pixel circuit 100 corresponding to a timing (7), as GI rises up to VH, the transistor M3 is turned off and Vg is set to a voltage based on a threshold voltage Vth of the transistor M1. An operation of setting Vg according to the threshold voltage of the transistor M1 is referred to as a threshold voltage (Vth) compensation operation.

Figure 13:
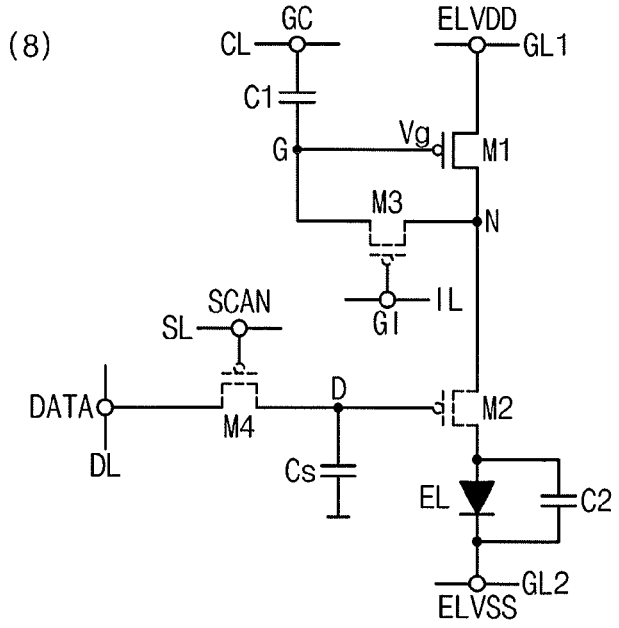

Referring to FIG. 13 which shows a driving state of the pixel circuit 100 corresponding to a timing (8), ELVDD rises up to VH and ELVSS decreases into VL. With this condition, the light emitting diode EL becomes a state that can emit a light when the transistor M2 is turned on. Also, the transistor M1 operates as a constant current source enabling a constant current to flow according to the set Vg. At this time, although threshold voltages of the transistors M1 of pixels in the pixel circuit 100 are different from one another, the same amount of current is supplied to the light emitting diodes EL emitting the same color. The reason is that Vg is set by the threshold voltage (Vth) compensation operation.

Referring to the timing (8) illustrated in FIG. 13, the constant current setting period SP ends. As a data signal DATA is provided to a node D of a pixel of the pixel circuit 100 selected by a scanning signal SCAN (i.e., a pixel of the pixel circuit 100 corresponding to the scanning signal SCAN having VL2), a voltage VH or a voltage VL is maintained during a sub-frame period. With this condition, the transistor M2 is turned on or turned off, the light emitting diode EL is switched into a light emission state or a non-light emission state during each sub-frame period, and PWM light emission control is implemented. Since a voltage VH of the node D is maintained during a black period, the light emitting diode EL becomes a non-light emission state.

As described above, in PWM light emission control for driving of the pixel circuit 100 according to an embodiment, a variation in a light emission level of a light emitting diode EL of each pixel in the pixel circuit 100 is reduced by implementing a pixel by at least four transistors. Also, since Vg is not set using capacitive coupling, it is possible to set a constant current more accurately as compared to a conventional manner.

Thus, according to an embodiment, contrast may be improved without increasing a number of transistors. In contrast, a conventional manner of improving contrast necessitates an increase in the number of transistors to improve the contrast. Conventionally, if the number of transistors is maintained, the contrast is lowered. Thus, according to an embodiment, a high density display unit may be readily achieved as compared to a conventional manner.

In the pixel circuit 100 according to an embodiment, the constant current circuit 200 is connected to the power line GL1 and the switch circuit 300 is provided between an anode of a light emitting diode EL and the constant current circuit 200. Meanwhile, a pixel circuit according to another embodiment is different from the pixel circuit 100 due to different connections between components.

Figure 14:
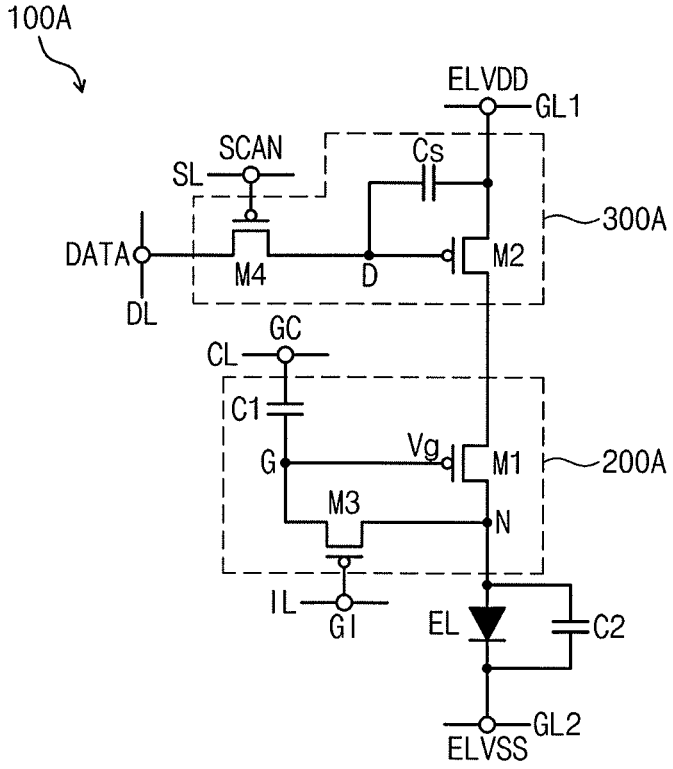
FIG. 14 is a circuit diagram schematically illustrating a pixel circuit 100A according to another embodiment.

FIG. 14 is a circuit diagram schematically illustrating a pixel circuit 100A according to another embodiment. The pixel circuit 100A includes a constant current circuit 200A and a switch circuit 300A, wherein the switch circuit 300A is connected to the power line GL1 and constant current circuit 200A is provided between an anode of a light emitting diode EL and the switch circuit 300A.

The constant current circuit 200A illustrated in FIG. 14 includes the same components as those in the constant current circuit 200 according to the previous embodiment, but connection between a transistor M1 and other components is changed. One of the source and drain terminals of the transistor M1 is connected to one of the source and drain terminals of a transistor M2, and another one thereof is connected to an anode of a light emitting diode EL. In FIG. 14, a node N indicates where the transistor M1 and the light emitting diode EL are connected.

The switch circuit 300A illustrated in FIG. 14 includes the same components as those in the switch circuit 300 according to the previous embodiment, but connection between a transistor M2 and other components is changed. Also, a connection relation of a capacitive element Cs is changed. One of source and drain terminals of the transistor M2 is connected to a power line GL1, and another one thereof is connected to the transistor M1. A first electrode of the capacitive element Cs is connected to a node D and a second electrode thereof is connected to the power line GL1.

Figure 15:
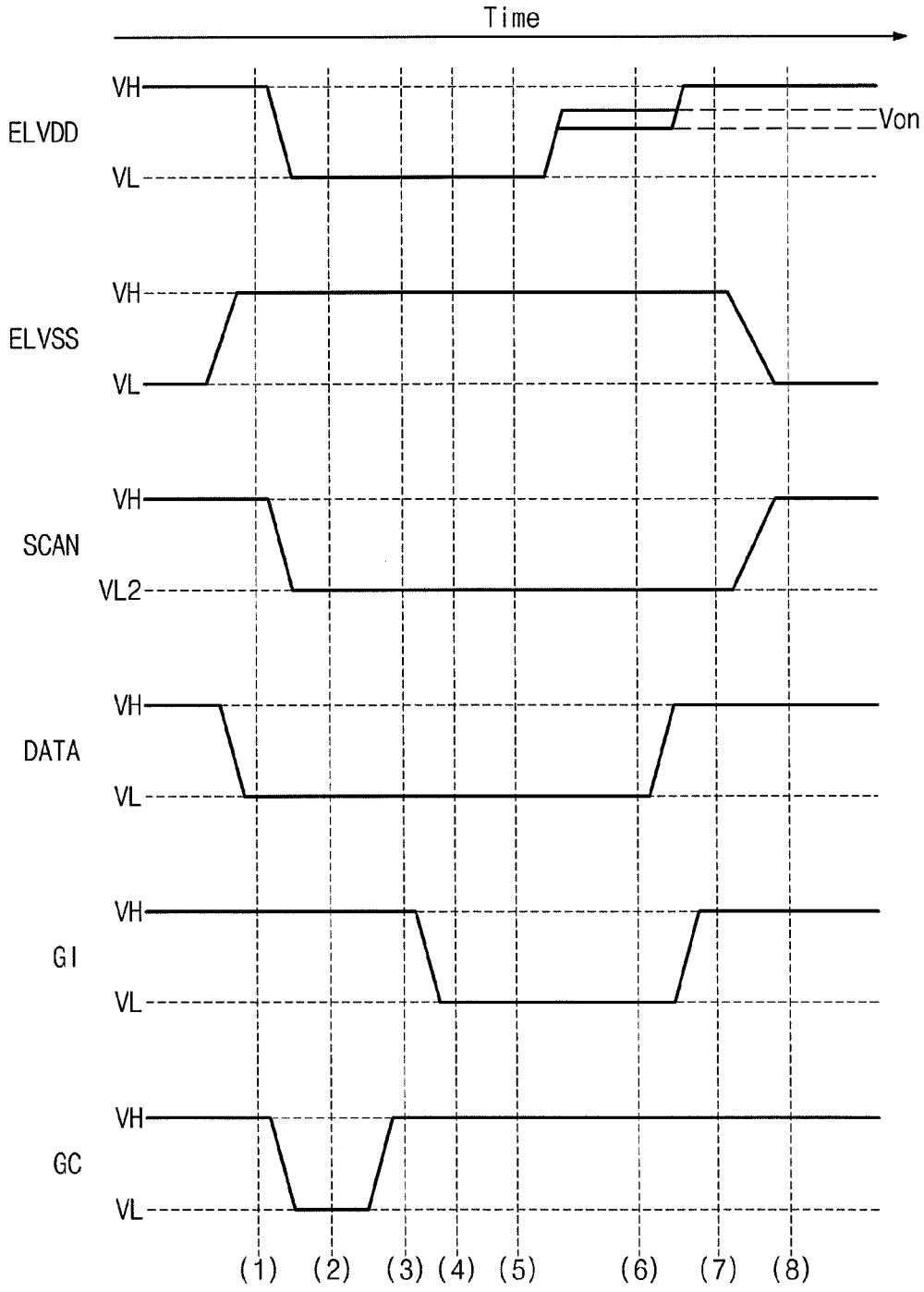
FIG. 15 is a timing diagram schematically illustrating variations of signals during a constant current setting period, according to another embodiment.

FIG. 15 is a timing diagram schematically illustrating variations of signals during a constant current setting period, according to another embodiment. A timing chart illustrated in FIG. 15 is different from that illustrated FIG. 5 in that a voltage switching timing is varied. An operation of a pixel circuit 100A will be more fully described with reference to FIGS. 16 to 23.

FIGS. 16 to 23 are diagrams schematically illustrating driving states of a pixel circuit 100A corresponding to timings (1) to (8) illustrated in FIG. 15, according to another embodiment.

Figure 16:
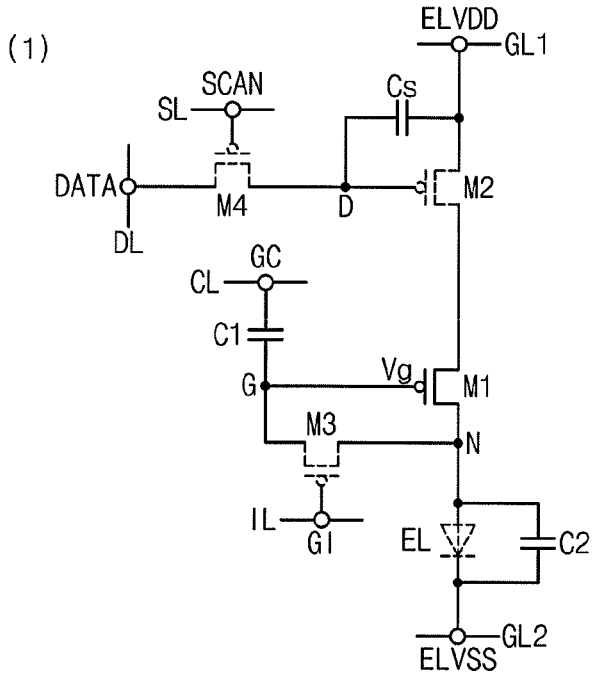
FIGS. 16 to 23 are diagrams schematically illustrating driving states of a pixel circuit 100A corresponding to timings (1) to (8) illustrated in FIG. 15, according to another embodiment.

Referring to FIG. 16, which shows a driving state of a pixel circuit 100A corresponding to a timing (1), since the transistor M2 is at a turn-off state, no current flows to a light emitting diode EL. Since the transistor M1 maintains a state of a previous frame, it may be turned on. Also, since the voltage VH is applied to gate terminals of transistors M2 to M4, the transistors M2 to M4 are turned off.

Figure 17:
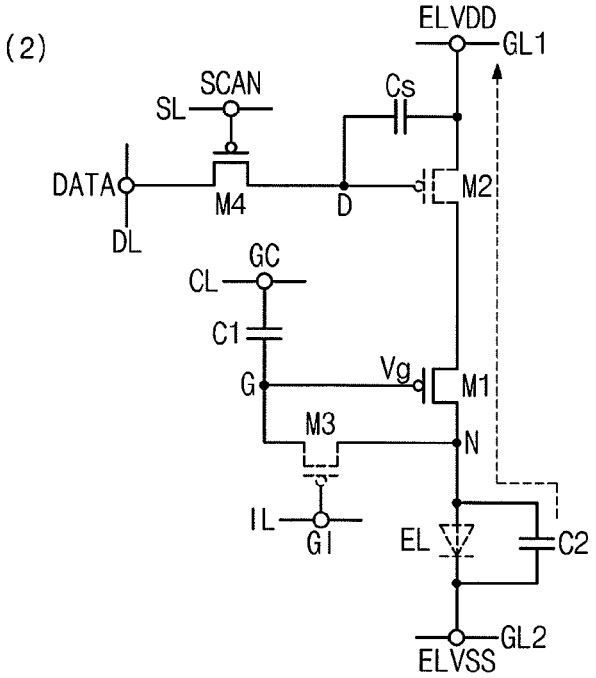

Referring to FIG. 17, which shows a driving state of the pixel circuit 100A corresponding to a timing (2), since ELVDD becomes VL and is lower than ELVSS, the light emitting diode EL is reversely biased, so that no current flows to the light emitting diode EL. That is, light is not emitted. Also, a voltage relation between ELVDD and ELVSS is set such that the light emitting diode EL is at a non-light emission state. Meanwhile, as GC is decreased to VL, Vg is lowered due to capacitive coupling. At this time, although ELVDD goes to VL, the transistor M1 maintains a turn-on state.

As SCAN is lowered toward VL2, the transistor M4 is turned on in the timing (2). At this time, the voltage VL of the data signal DATA is applied to a node D. Thus, the transistor M2 is turned on. With this bias condition, an electrode of a capacitive component C2 connected to the node N is connected to a power line GL1, so that charges are transferred. Thus, a voltage of the node N is decreased.

At this time, although the transistors M1 and M2 are simultaneously turned on, the light emitting diode EL maintains a non-light emission state by a voltage relation between ELVDD and ELVSS.

Figure 18:
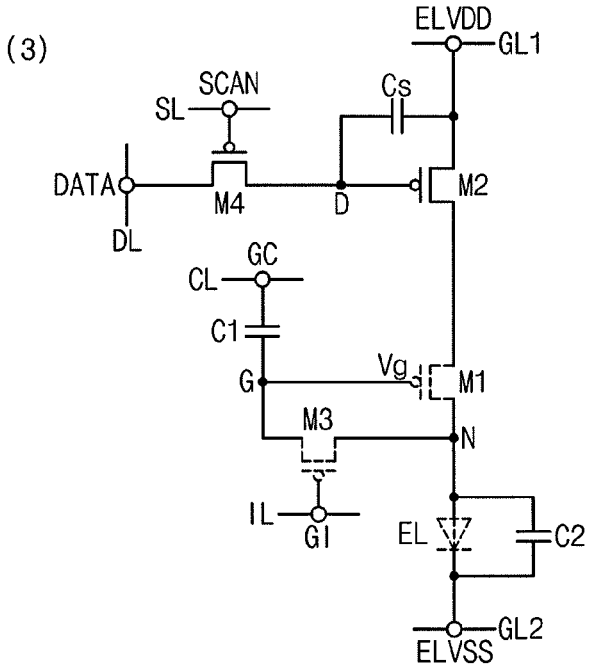

Referring to FIG. 18, which shows a driving state of the pixel circuit 100A corresponding to a timing (3), as GC is increased up to VH, Vg is increased by the capacitive coupling. Thus, the transistor M1 is turned off.

Figure 19:
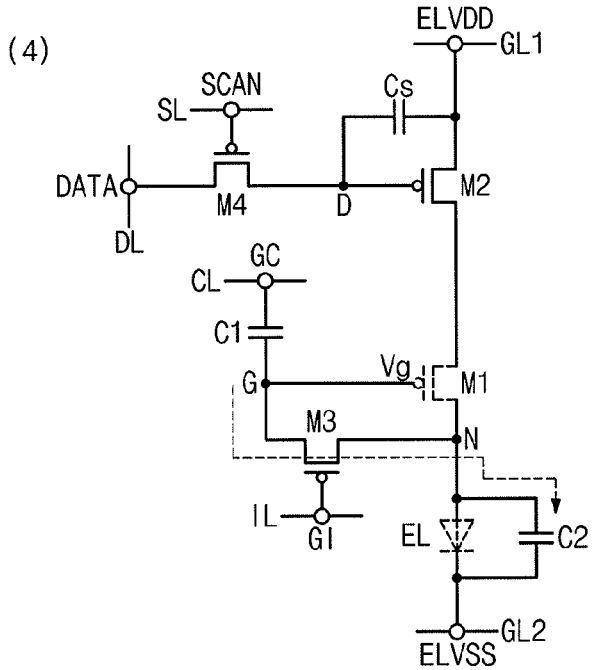

Referring to FIG. 19, which shows a driving state of the pixel circuit 100A corresponding to a timing (4), as GI is decreased to VL, a transistor M3 is turned on. At this time, an electrode of the capacitive component C1 connected to a node G is connected to the node N, so that charges are transferred. That is, Vg (a voltage of the node G) is lowered (a reset operation). In this case, since a voltage of the node N is equal to Vg, the transistor M1 maintains a turn-off state.

Figure 20:
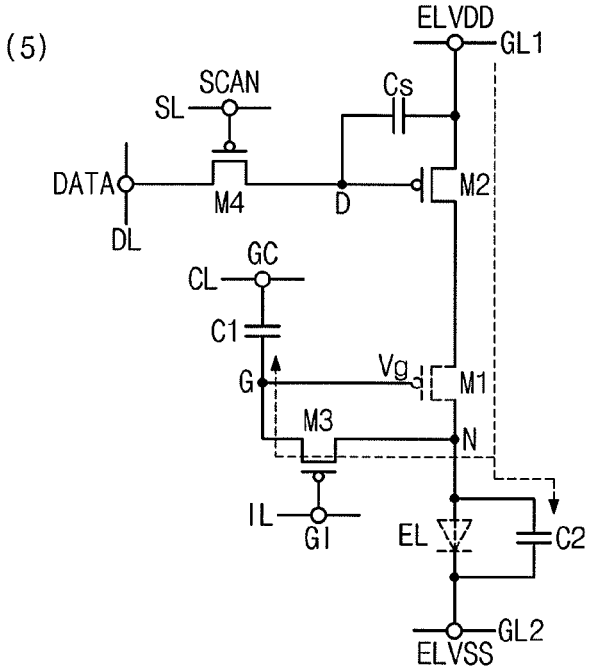

Referring to FIG. 20 which shows a driving state of the pixel circuit 100A corresponding to a timing (5), as ELVDD rises up to Von, the transistor M1 is turned on. At this time, since a voltage of Vg is lowered by a reset operation (refer to a timing (4) illustrated in FIG. 19), the transistor M1 is fully turned on.

With the above description, since the node G is connected to the power line GL1, charges are transferred. Thus, Vg rises up to (Von−|Vth|). At this time, since ELVDD becomes one of Von(R), Von(G), and Von(B) according to a light emission color of the light emitting diode EL, a value of Vg is varies in accordance with color.

Figure 21:
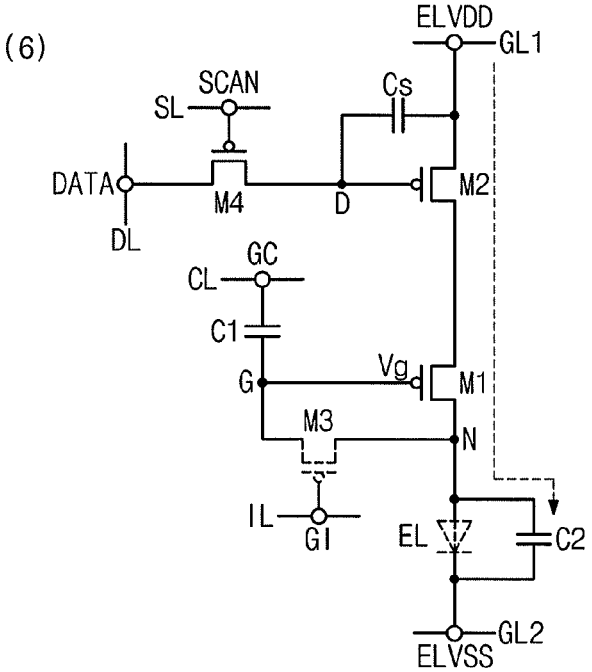

Referring to FIG. 21 which shows a driving state of the pixel circuit 100A corresponding to a timing (6), as GI rises up to VH, the transistor M3 is turned off, and Vg is set to a voltage based on a threshold voltage Vth of the transistor M1.

Also, since the transistors M1 and M2 are simultaneously turned on as illustrated in the timings (5) and (6), in the capacitive component C2, the node N (an anode of the light emitting diode EL) is connected to the power line GL1 and charges are transferred. But, the light emitting diode EL maintains a non-light emission state due to a voltage relation between ELVDD and ELVSS.

Figure 22:
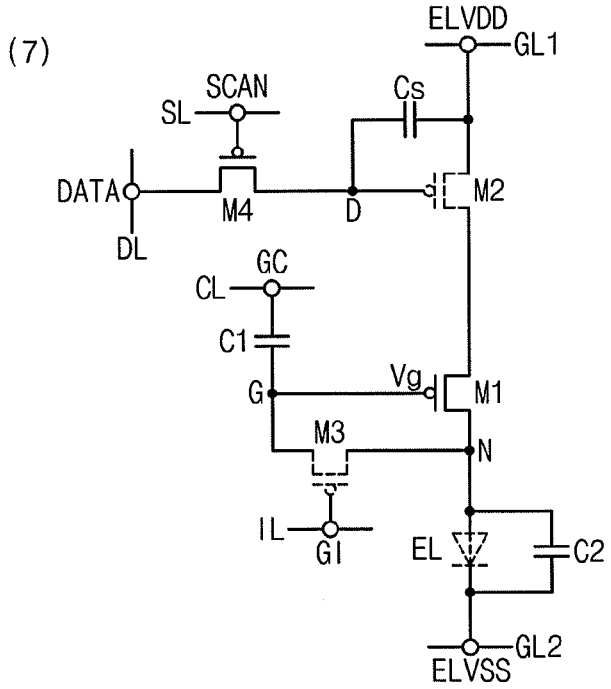

Referring to FIG. 22 which shows a driving state of the pixel circuit 100A corresponding to a timing (7), ELVDD, DATA, and a voltage of the node D rise up to VH, so that the transistor M2 is turned off.

Figure 23:
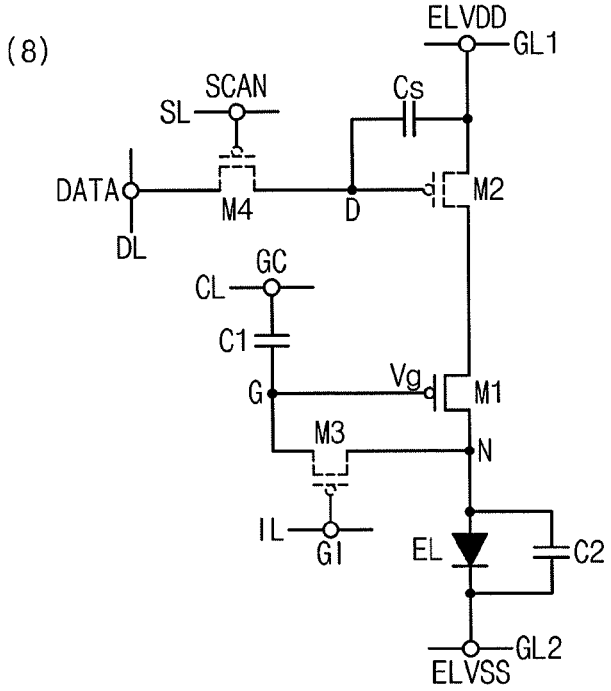

Referring to FIG. 23 which shows a driving state of the pixel circuit 100A corresponding to a timing (8), SCAN becomes VH and the transistor M4 is turned off. Also, during a constant current setting period SP, SCAN may maintain VL2.

Also, ELVSS falls to VL. With this condition, the light emitting diode EL becomes a state that can emit light when the transistor M2 is turned on. Also, the transistor M1 operates as a constant current source enabling a constant current to flow according to the set Vg. At this time, although threshold voltages of the transistors M1 of pixels in the pixel circuit 100A are different from one another, the same amount of current is supplied to the light emitting diodes EL emitting the same color. The reason is that Vg is set by the threshold voltage (Vth) compensation operation.

Referring to the timing (8) illustrated in FIG. 23, the constant current setting period SP ends. As a data signal DATA is provided to the node D of a pixel of the pixel circuit 100A selected by a scanning signal SCAN (i.e., a pixel of the pixel circuit 100A corresponding to the scanning signal SCAN having VL2), a voltage VH or a voltage VL is maintained during a sub-frame period. With this condition, the transistor M2 is turned on or turned off, the light emitting diode EL is switched into a light emission state or a non-light emission state during each sub-frame period, and PWM light emission control is implemented. Since a voltage VH of the node D is maintained during a black period, the light emitting diode EL becomes a non-light emission state. The pixel circuit 100A according to the current embodiment may have the same effect as that according to the previous embodiment.

According to another embodiment, the transistor M2 is turned on during a threshold voltage compensation operation. Meanwhile, power consumption is reduced by narrowing a voltage amplitude of a data signal DATA at PWM light emission control. In PWM light emission control, a voltage of a node N placed at a source side of the transistor M2 according to an embodiment is variable according to whether the transistor M2 is turned on or turned off, while a source terminal of the transistor M2 according to another embodiment is connected to a power line GL1 fixed to a voltage VH. Thus, a voltage VL of the data signal DATA may be closer in level to a voltage VH.

First Modified Embodiment

Referring to a timing (6) according to an embodiment or a timing (5) according to another embodiment, the amount of constant current at PWM light emission control is varied every light emission color by setting ELVDD to one of Von (R), Von(G), Von(B) according to a light emission color of a light emitting diode EL. A method of changing the amount of constant current every light emission color at PWM light emission control may be variously changed or modified.

In a method according to the first modified embodiment, referring to a timing (6) according to an embodiment or a timing (5) another embodiment, ELVDD is fixed to the same voltage Von(C) regardless of a light emission color. Referring to a timing (8) according to an embodiment or a timing (8) according to another embodiment, it is possible to vary ELVDD every light emission color. That is, in embodiments, it is possible to use VH(R), VH(G), and VH(B) as a voltage VH of ELVDD every light emission color.

Second Modified Embodiment

Referring to a timing (5) according to an embodiment, DATA is set to VH. However, VL may be maintained, and then may be switched into VH before a timing (8). In this case, after DATA is switched from VL to VH, SCAN may be switched from VL to VH. In this case, since an electrode of a capacitive component C2 placed at a side of a node N is connected to a power line GL1, it is possible to implement a threshold voltage (Vth) compensation operation.

Third Modified Embodiment

While embodiments have been describe above in which each component is a p-type transistor, embodiments are not limited thereto. For example, each component may be formed of an n-type transistor or of p-type and n-type transistors. Although the different types of transistors cannot be employed in identical circuits to those above-described, the driving circuit and method thereof may be modified using implementable circuits.

By way of summation and review, according to embodiments, a display device having a reduced number of transistors per pixel may be realized, allowing high density display devices to be achieved. Embodiments may also reduce influence of a characteristic variation of a transistor on a display image and/or improve contrast.

In exemplary embodiments, when the gate terminal of the first transistor is set to the voltage corresponding to an amount of the supply current, the driver circuit turns the second transistor off. According to one or more embodiments, time taken to set a constant current of the constant current circuit may be reduced. Further, since the constant current is not set using capacitive coupling, setting thereof may be more accurate.

In contrast, conventionally compensation techniques involved tradeoffs between an increased number of transistors and reduced contrast, e.g., due to current flowing to the light emitting diode during setting of the constant current. Further, the conventional use of capacitive coupling to set the constant current increases the time for the current to be set and reduces the accuracy thereof.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a pixel circuit including a light emitting diode that emits light according to a supplied current; and a driver circuit to drive the pixel circuit such that the light emitting diode emits light, wherein the pixel circuit further includes:

a constant current circuit including a first transistor to control an amount of the supply current to the light emitting diode and a capacitive element connected to a gate terminal of the first transistor; and a switch circuit including a second transistor to select whether to switch the supply current and a fourth transistor between a data line and a gate terminal of the second transistor and having a gate terminal connected to a third signal line, the first and second transistors being connected in series between a first power line and an anode of the light emitting diode having a cathode connected to a second power line, wherein the driver circuit controls the pixel circuit such that the light emitting diode emits light by:

connecting the anode of the light emitting diode and the first power line under a non-light emission state of the light emitting diode, connecting the gate terminal of the first transistor and the anode after the anode is disconnected from the first power line, setting the gate terminal of the first transistor to a voltage corresponding to the amount of the supply current by connecting the gate terminal of the first transistor and the first power line, and, after setting the gate terminal, switching the supply current through the second transistor under a light emission state of the light emitting diode.

2. The display device of claim 1, wherein:

the capacitive element is between the gate terminal of the first transistor and a first signal line, the constant current circuit further includes a third transistor having a gate terminal connected to a second signal line and between the gate terminal of the first transistor and a terminal of the first transistor placed at a side of the light emitting diode, wherein the driver circuit drives the pixel circuit by controlling voltages of the first power line, the second power line, the first signal line, the second signal line, the third signal line, and the data line.

3. The display device of claim 2, wherein the second transistor is connected between the first transistor and the anode.

4. The display device of claim 3, wherein, when the gate terminal of the first transistor is set to the voltage corresponding to the amount of the supply current, the driver circuit turns the second transistor off.

5. The display device of claim 2, wherein the first transistor is connected between the second transistor and the anode.

6. An electronic device, comprising:

a display device of claim 1; and a control unit to control the driver circuit based on input image data.

7. A method of driving a pixel circuit that includes a light emitting diode that emits light according to a supply current; a constant current circuit including a first transistor to control an amount of the supply current to the light emitting diode and a capacitive element connected to a gate terminal of the first transistor; and a switch including a second transistor to select whether to switch the supply current and a fourth transistor between a data line and a gate terminal of the second transistor and having a gate terminal connected to a third signal line, the first and second transistors being connected in series between a first power line and an anode of the light emitting diode having a cathode connected to a second power line, the method comprising:

connecting the anode of the light emitting diode and the first power line under a non-light emission state of the light emitting diode;

then connecting the gate terminal of the first transistor and the anode after the anode is disconnected from the first power line;

setting the gate terminal of the first transistor to a voltage corresponding to the amount of the supply current by connecting the gate terminal of the first transistor and the first power line, and after setting the gate electrode, switching the supply current through the second transistor under a light emission state of the light emitting diode such that the light emitting diode emits light.

8. A driver circuit for a pixel circuit that includes a light emitting diode emitting a light according to a supply current; a constant current circuit including a first transistor to control an amount of the supply current to the light emitting diode and a capacitive element connected to a gate terminal of the first transistor; and a switch including a second transistor to select whether to switch the supply current and a fourth transistor between a data line and a gate terminal of the second transistor and having a gate terminal connected to a third signal line, the first and second transistors being connected in series between a first power line and an anode of the light emitting diode having a cathode connected to a second power line, the driver circuit to:

connect the anode of the light emitting diode and the first power line under a non-light emission state of the light emitting diode;

then connect the gate terminal of the first transistor and the anode after the anode is disconnected from the first power line;

set the gate terminal of the first transistor to a voltage corresponding to the amount of the supply current by connecting the gate terminal of the first transistor and the first power line; and after the gate terminal is set, switch the supply current through the second transistor under a light emission state of the light emitting diode such that the light emitting diode emits a light.

* * * * *